US010959007B2

(12) United States Patent
Levine et al.

(10) Patent No.: US 10,959,007 B2
(45) Date of Patent: Mar. 23, 2021

(54) AUDIO HEADSET HAVING INTERNAL CORD MANAGEMENT FEATURES AND RELATED TECHNOLOGY

(71) Applicant: New Audio LLC, New York, NY (US)

(72) Inventors: Jonathan E. Levine, New York, NY (US); Drew Stone Briggs, Seattle, WA (US); Marten Andersson, Malmo (SE); Thomas C. Wilson, Brooklyn, NY (US)

(73) Assignee: New Audio LLC, New York, NY (US)

( * ) Notice: Subject to any disclaimer, the term of this patent is extended or adjusted under 35 U.S.C. 154(b) by 128 days.

(21) Appl. No.: 16/396,489

(22) Filed: Apr. 26, 2019

(65) Prior Publication Data

US 2019/0387303 A1 Dec. 19, 2019

Related U.S. Application Data

(63) Continuation of application No. 15/667,561, filed on Aug. 2, 2017, now Pat. No. 10,327,057, which is a continuation of application No. 14/821,619, filed on Aug. 7, 2015, now Pat. No. 9,729,954.

(51) Int. Cl.
*H04R 25/00* (2006.01)
*H04R 1/10* (2006.01)

(52) U.S. Cl.
CPC ..... *H04R 1/1033* (2013.01); *H04R 1/105* (2013.01); *H04R 1/1066* (2013.01); *H04R 1/1008* (2013.01)

(58) Field of Classification Search
CPC combination set(s) only.
See application file for complete search history.

(56) References Cited

U.S. PATENT DOCUMENTS 3,922,725 A 12/1975 Csiki et al.
5,035,005 A 7/1991 Hung
(Continued)

FOREIGN PATENT DOCUMENTS

JP 2015026948 A 2/2015

OTHER PUBLICATIONS

International Search Report and Written Opinion for PCT/US2016/045859 filed Aug. 5, 2016, dated Nov. 1, 2016 from the ISA/KR International Application Division, Korean Intellectual Property Office, 15 pages.

*Primary Examiner* — Amir H Etesam
(74) *Attorney, Agent, or Firm* — Holzer Patel Drennan

(57) ABSTRACT

A headset in accordance with an embodiment of the present technology includes a headpiece, an earpiece, an arm extending therebetween, and a cord extending through the arm. The arm includes elongate first and second segments through which the arm is operably connected to the earpiece and the headpiece, respectively. The first and second segments have a telescoping arrangement such that the arm is movable between a lengthened state and a shortened state. The arm further includes a hinge operable to rotate the arm about an axis and thereby move the arm relative to the headpiece between a folded state and an unfolded state. Increased slack in the cord preferentially gathers within an interior region of the second segment when the arm moves from the lengthened state toward the shortened state and when the arm moves from the folded state toward the unfolded state.

9 Claims, 6 Drawing Sheets

(56) References Cited

U.S. PATENT DOCUMENTS

| | | | | |
|---|---|---|---|---|
| 5,438,626 | A * | 8/1995 | Neuman | H04R 5/0335 381/370 |
| D410,466 | S | 6/1999 | Mouri et al. | |
| 8,325,962 | B2 * | 12/2012 | Ishida | H04R 5/0335 381/370 |
| 8,737,668 | B1 | 5/2014 | Blair et al. | |
| D727,280 | S | 4/2015 | Levine | |
| D727,281 | S | 4/2015 | Levine | |
| D736,174 | S | 8/2015 | Levine | |
| D736,175 | S | 8/2015 | Levine | |
| D741,842 | S | 10/2015 | Levine | |
| D762,190 | S | 7/2016 | Levine | |
| D762,191 | S | 7/2016 | Levine | |
| D772,841 | S | 11/2016 | Levine | |
| D780,155 | S | 2/2017 | Levine et al. | |
| D781,265 | S | 3/2017 | Levine et al. | |
| D781,814 | S | 3/2017 | Levine | |
| 9,729,954 | B2 | 8/2017 | Levine et al. | |
| D805,056 | S | 12/2017 | Levine | |
| D810,055 | S | 2/2018 | Levine | |
| D812,588 | S | 3/2018 | Levine | |
| D832,811 | S | 11/2018 | Levine et al. | |
| D832,813 | S | 11/2018 | Levine et al. | |
| 2003/0210801 | A1 | 11/2003 | Naksen et al. | |
| 2004/0216946 | A1 | 11/2004 | Lenhard-Backhaus | |
| 2005/0266875 | A1 | 12/2005 | Yegin et al. | |
| 2007/0223766 | A1 | 9/2007 | Davis et al. | |
| 2008/0056525 | A1 | 3/2008 | Fujiwara et al. | |
| 2010/0177907 | A1 | 7/2010 | Morisawa | |
| 2012/0070028 | A1 | 3/2012 | Margulies | |
| 2012/0093334 | A1 | 4/2012 | Schreuder et al. | |
| 2016/0079660 | A1 | 3/2016 | Bevelacqua | |
| 2016/0205461 | A1 | 7/2016 | Fernandez-Medina et al. | |
| 2017/0041696 | A1 | 2/2017 | Levine et al. | |
| 2017/0041697 | A1 | 2/2017 | Levine | |
| 2017/0134845 | A1 | 5/2017 | Milam et al. | |
| 2017/0265420 | A1 | 9/2017 | Carlson | |
| 2017/0339479 | A1 | 11/2017 | Levine | |
| 2018/0020277 | A1 | 1/2018 | Briggs | |
| 2018/0020278 | A1 | 1/2018 | Levine et al. | |

* cited by examiner

AUDIO HEADSET HAVING INTERNAL CORD MANAGEMENT FEATURES AND RELATED TECHNOLOGY

CROSS-REFERENCE TO RELATED APPLICATION INCORPORATED BY REFERENCE

This is a continuation of U.S. application Ser. No. 15/667,561, filed on Aug. 2, 2017, now U.S. Pat. No. 10,327,057, which is a continuation of U.S. application Ser. No. 14/821,619, filed on Aug. 7, 2015, now U.S. Pat. No. 9,729,954, which is incorporated herein by reference in its entirety.

TECHNICAL FIELD

The present technology is related to audio headsets, which are wearable devices that convey sound to one or both of a user's ears.

BACKGROUND

Audio headsets are used for listening to music, playing video games, telephonic communication, noise cancelling, etc. The basic form of conventional audio headsets has remained fairly consistent for several decades. A typical dual-earpiece audio headset includes earpieces at respective ends of a headpiece shaped to bridge a user's head. Each of the earpieces includes a speaker that converts an audio signal into sound. The sound is generated in close proximity to a user's ear, so the sound can be fully audible to the user while still being inaudible or minimally audible to others around the user. This makes audio headsets ideal for use in public settings.

Unlike the basic form, the manner in which audio signals are conveyed from sources (e.g., music players) to earpieces varies among conventional headsets. One type of conventional headset includes an external cord that splits into two branches. One branch directly connects to a first earpiece and the other branch directly connects to an opposite second earpiece. Unfortunately, these branches are often prone to tangling. Furthermore, the branches often merge at a crook that is highly susceptible to damage. Another type of conventional headset includes a bridging cord that connects earpieces to one another through an associated headpiece. In this type of conventional headset, both of the earpieces can be operable even when only one of the earpieces is connected to a source. Conventionally, however, it has been difficult to effectively manage slack in the bridging cord that develops when the headset is adjusted for fit. In one example of a conventional approach to this problem, a bridging cord is exposed at joints in a headset so that the bridging cord can bulge or otherwise deform as needed in response to changes in slack. This approach is suboptimal. For example, exposed portions of the bridging cord may interfere with operation of the associated joints, snag during handling of the headset, interfere with the visual continuity of the headset form, and/or have other disadvantages. For these and/or other reasons, there is a need for innovation in this field.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical, similar, or analogous components or features of more than one embodiment of the present technology.

DETAILED DESCRIPTION

Headsets and related devices, systems, and methods in accordance with embodiments of the present technology can at least partially address one or more problems associated with conventional technologies whether or not such problems are stated herein. For example, headsets in accordance with at least some embodiments of the present technology have innovative features that facilitate reliable management of bridging-cord slack in conjunction with fit adjustments and/or headset folding. A headset in accordance with a particular embodiment of the present technology includes a headpiece, an earpiece, an arm extending therebetween, and a cord extending through the arm. The arm is adjustable for fit and foldable to facilitate compact storage of the headset. Both adjustment and folding of the arm can change an amount of slack in the cord. The arm can include features that manage this slack internally. For example, the arm can include telescoping segments that cooperate to cause the slack to gather and be drawn from a consistent internal location shaped to reduce or eliminate snagging, kinking, doubling over, and/or other undesirable cord behavior. In contrast to conventional headsets, this headset and other headsets in accordance with embodiments of the present technology can be more durable, more versatile, more reliable, and/or have other advantages.

Specific details of headsets and related devices, systems, and methods in accordance with several embodiments of the present technology are described herein with reference to FIGS. 1-13. Although headsets and related devices, systems, and methods may be disclosed herein primarily or entirely in the context of dual-earpiece, over-ear headsets, other contexts in addition to those disclosed herein are within the scope of the present technology. For example, features of described dual-earpiece, over-ear headsets can be implemented in the context of single-earpiece headsets, on-ear headsets, in-ear headsets, and earbud-type headsets, among other examples. Furthermore, it should understood, in general, that other systems, devices, and methods in addition to those disclosed herein are within the scope of the present technology. For example, systems, devices, and methods in accordance with embodiments of the present technology can have different and/or additional configurations, components, and procedures than those disclosed herein. Moreover, a person of ordinary skill in the art will understand that systems, devices, and methods in accordance with embodiments of the present technology can be without one or more of the configurations, components, and/or procedures disclosed herein without deviating from the present technology.

Figure 1:
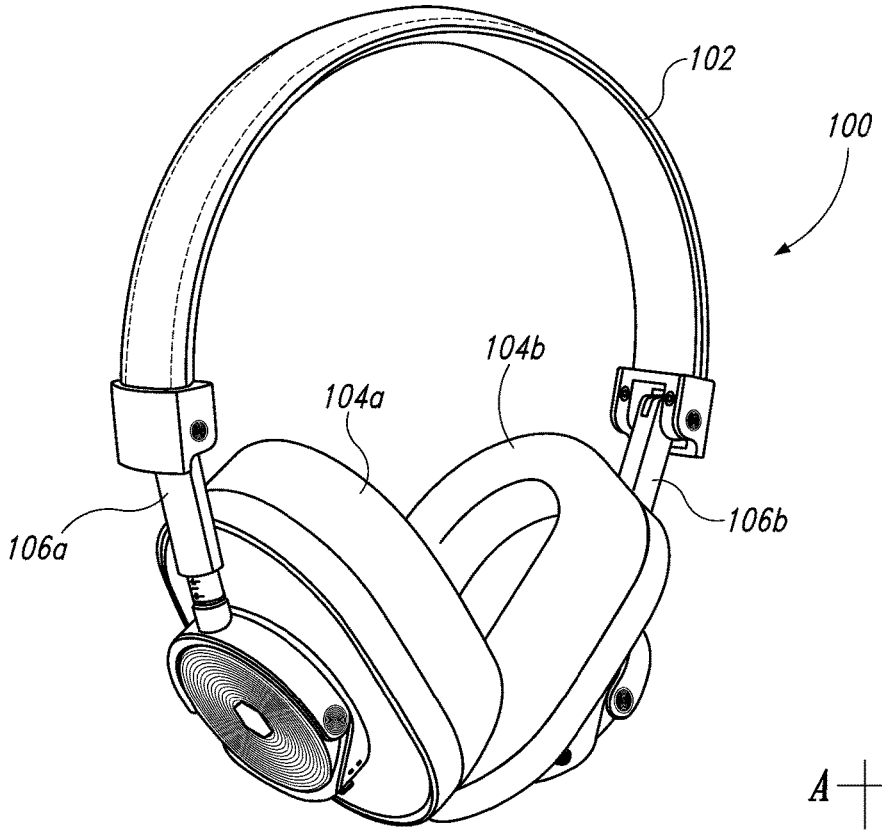
FIG. 1 is a perspective view of a headset in accordance with an embodiment of the present technology.

FIG. 1 is a perspective view of a headset 100 in accordance with an embodiment of the present technology. The headset 100 can include an arcuate headpiece 102 configured to fit over a user's head. The headset 100 can further include opposing earpieces 104 (individually identified as earpieces 104*a*, 104*b*) and opposing arms 106 (individually identified as arms 106*a*, 106*b*) extending between the headpiece 102 and the earpieces 104, respectively. Features of the earpieces 104 and the arms 106 are further discussed herein with respect to the earpiece 104*a* and the arm 106*a* with the understanding that corresponding features can similarly be present in the earpiece 104*b* and the arm 106*b*.

Figure 2:
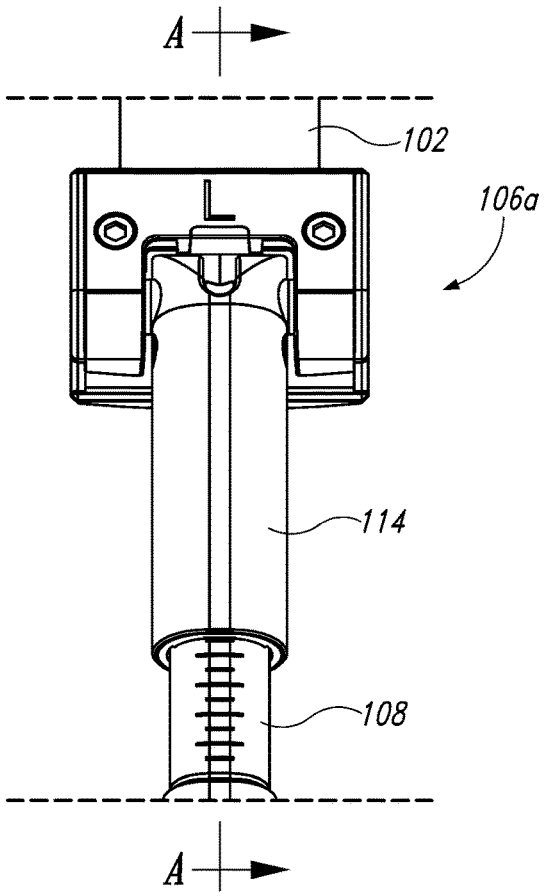
FIG. 2 is a front profile view of an arm of the headset shown in FIG. 1.
Figure 3:
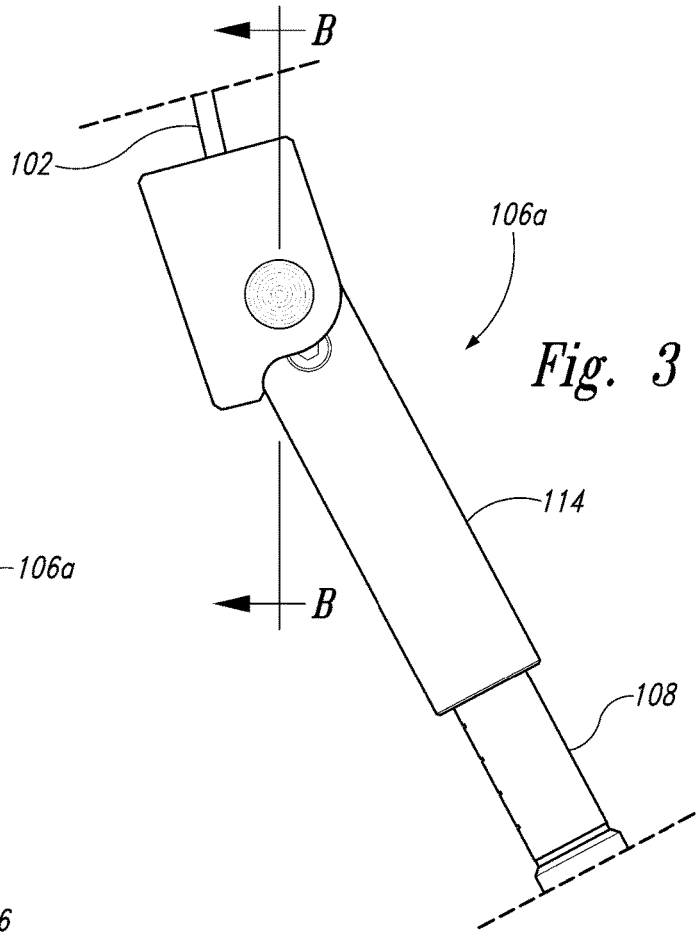
FIG. 3 is a side profile view of the arm of the headset shown in FIG. 1.
Figure 4:
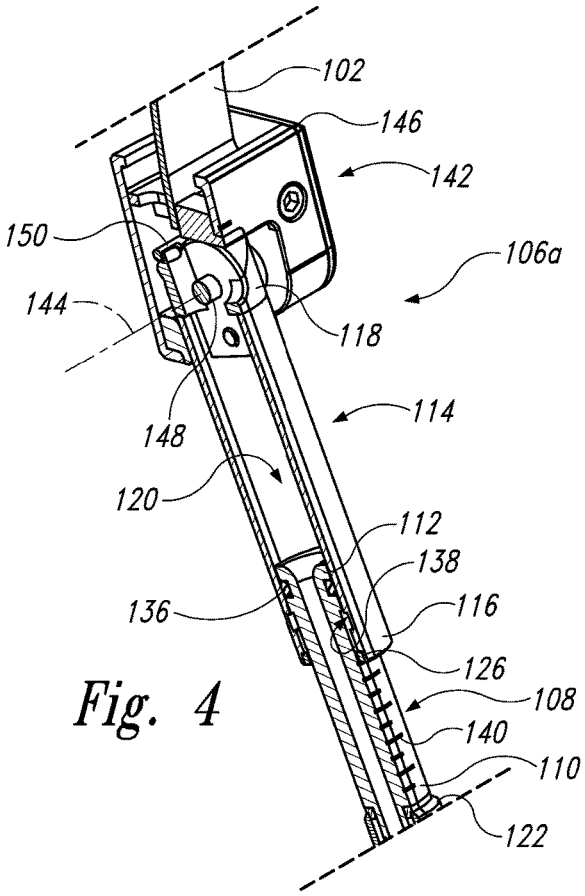
FIG. 4 is a cross-sectional isometric view of the arm of the headset shown in FIG. 1 taken along the line A-A in FIG. 2.

FIGS. 2 and 3 are a front profile view and a side profile view, respectively, of the arm 106*a*. FIG. 4 is a cross-sectional isometric view of the arm 106*a* taken along the line A-A in FIG. 2. With reference to FIGS. 2-4 together, the arm 106*a* can include an elongate first segment 108 through which the arm 106*a* is operably connected to the earpiece 104*a*. A first end portion 110 of the first segment 108 can be closer to the earpiece 104*a* than an opposite second end portion 112 of the first segment 108. The arm 106*a* can further include an elongate second segment 114 through which the arm 106*a* is operably connected to the headpiece 102. A first end portion 116 of the second segment 114 can be closer to the earpiece 104*a* than an opposite second end portion 118 of the second segment 114. The first and second segments 108, 114 can have a telescoping arrangement in which in longitudinal movement of the first segment 108 relative to the second segment 114 changes a length of the arm 106*a*. For example, the second segment 114 can define an interior region 120 within which the second end portion 112 of the first segment 108 is disposed and longitudinally movable. By moving the first segment 108 relative to the second segment 114, a user can adjust a spacing between the headpiece 102 and the earpiece 104*a* to achieve a suitable fit for the headset 100.

Figure 5:
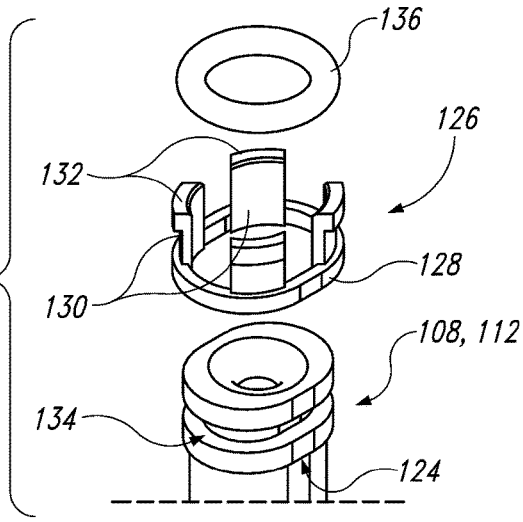
FIG. 5 is an exploded perspective view of an end portion of a first segment and associated components of the arm of the headset shown in FIG. 1.

FIG. 5 is an exploded perspective view of the second end portion 112 of the first segment 108 and associated components of the arm 106*a*. With reference now to FIGS. 2-5 together, the second end portion 112 of the first segment 108 can be captured within the interior region 120 of second segment 114 such that longitudinal movement of the first segment 108 relative to the second segment 114 is limited to a given range. In the illustrated embodiment, the headset 100 includes a first step 122 at the first end portion 110 of the first segment 108. The first step 122 can be positioned to abut the first end portion 116 of the second segment 114 and thereby block further longitudinal movement of the first segment 108 relative to the second segment 114 at one end of the given range. Similarly, in the illustrated embodiment, the first segment 108 includes a second step 124, and the headset 100 includes an annular retainer 126 that abuts the second step 124 and thereby blocks further longitudinal movement of the first segment 108 relative to the second segment 114 at the other end of the given range. In other embodiments, longitudinal movement of the first segment 108 relative to the second segment 114 can be constrained in another suitable manner.

With reference again to FIGS. 2-5, the retainer 126 can be installed within a portion of the interior region 120 of the second segment 114 at the first end portion 116 of the second segment 114 after the second end portion 112 of the first segment 108 is inserted into the interior region 120 of the second segment 114. The retainer 126 can include a ring 128 and circumferentially distributed posts 130 extending from one side of the ring 128. The posts 130 can be parallel and can include respective outwardly protruding heads 132. The second segment 114, at its first end portion 116, can include an inwardly opening groove 134 shaped to interlock with the heads 132. The posts 130 can be resiliently deformable to allow the corresponding heads 132 to move inwardly and outwardly relative to the ring 128 during installation of the retainer 126. Once installed, the first segment 108 can block inward deformation of the posts 130, thereby locking the heads 132 in the inwardly opening groove 134.

The retainer 126 can center a given portion of the first segment 108 within the portion of the interior region 120 of the second segment 114 at the first end portion 116 of the second segment 114. In addition or alternatively, the retainer 126 can lubricate longitudinal movement of the first segment 108 relative to the second segment 114. Suitable materials for the retainer 126 include polymeric materials (e.g., polyoxymethylene), among others. The headset 100 can further include an o-ring 136 that centers the second end portion 112 of the first segment 108 within the interior region 120 of the second segment 114 and/or provides a controlled amount of friction that resists longitudinal movement of the first segment 108 relative to the second segment 114. As shown in FIG. 2, the first segment 108, at its second end portion 112, can include an outwardly opening annular groove 138 in which the o-ring 136 can be seated. The controlled friction between the o-ring 136 and an inwardly facing surface of the second segment 114 can cause a position of the first segment 108 relative to the second segment 114 to persist after the length of the arm 106*a* is adjusted. Between its first and second end portions 110, 112, the first segment 108 can include a gauge 140 that is partially exposed and partially hidden within the interior region 120 of the second segment 114. The exposed portion of the gauge 140 can indicate the position of the first segment 108 relative to the second segment 114.

In the illustrated embodiment, the arm 106*a* is foldable in addition to having an adjustable length. For example, the arm 106*a* can include a hinge 142 operable to rotate the arm 106*a* about an axis 144 and thereby move the arm 106*a* relative to the headpiece 102 between a folded state and an unfolded state. In FIGS. 2-4, the arm 106*a* is shown in the unfolded state. The hinge 142 can include a shell 146 that connects the second segment 114 to the headpiece 102. The hinge 142 can further include an axle 148 that extends, at the axis 144, laterally within the shell 146 through the interior region 120 of the second segment 114. Also within the shell 146, the hinge 142 can include a spring pin 150 that interacts with the second segment 114 to provide tactile feedback to a user in conjunction with folding of the arm 106*a*.

Figure 6:
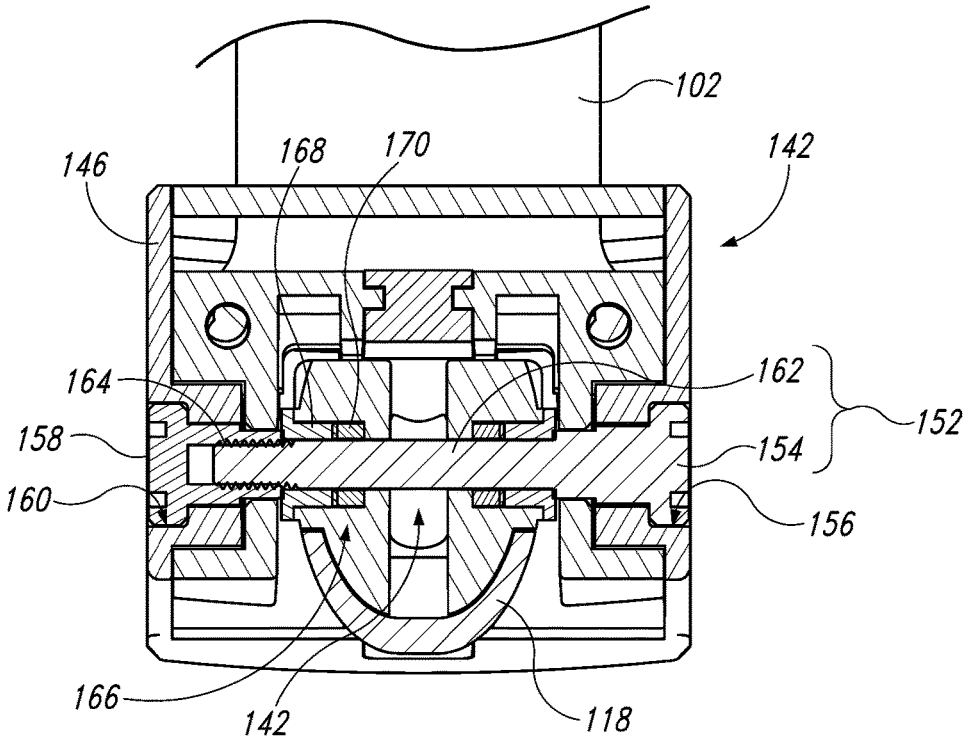
FIG. 6 is a cross-sectional front profile view of a hinge of the arm of the headset shown in FIG. 1 taken along the line B-B in FIG. 3.

FIG. 6 is a cross-sectional front profile view of the hinge 142 taken along the line B-B in FIG. 3. As shown in FIG. 6, the axle 148 can include a bolt 152 secured to the shell 146. The bolt 152 can include a head 154 seated in a first inset 156 at a first side of the shell 146. Similarly, the axle 148 can include a cap 158 seated in a second inset 160 at an opposite second side of the shell 146. The bolt 152 can further include a shaft 162 that extends from the head 154, through the second end portion 118 of the second segment 114 to the cap 158. The cap 158 and the bolt 152 can be secured to one another via complementary threads 164 within a blind channel within the cap 158 and a distalmost segment of the shaft 162 relative to the head 154.

The axle 148 can protrude from opposite sides of the interior region 120 of the second segment 114. These protruding portions of the axle 148 can be connected to bearings 166 (e.g., bushings) at opposite sides of the second end portion 118 of the second segment 114. The bearings 166 can facilitate rotation of the second segment 114 (and structures attached thereto) relative to the hinge 142. In the illustrated embodiment, each of the bearings 166 includes an outer portion 168 having a first stiffness and an inner portion 170 having a second stiffness less than that of the outer portion 168. For example, the outer portions 168 of the bearings 166 can be made of metal (e.g., copper or brass) and the inner portions 170 of the bearings 166 can be made of a resilient polymer (e.g., silicone). Due to their greater stiffness, the outer portions 168 of the bearings 166 can enhance the durability of the junction between the second end portion 118 of the second segment 114 and the shaft 162. In contrast, due to their lesser stiffness, the inner portions 170 of the bearings 166 can be well suited for forming a snug connection between the second end portion 118 of the second segment 114 and the shaft 162, thereby facilitating smooth operation of the junction. In other embodiments, the bearings 166 can have other suitable forms.

Figure 7:
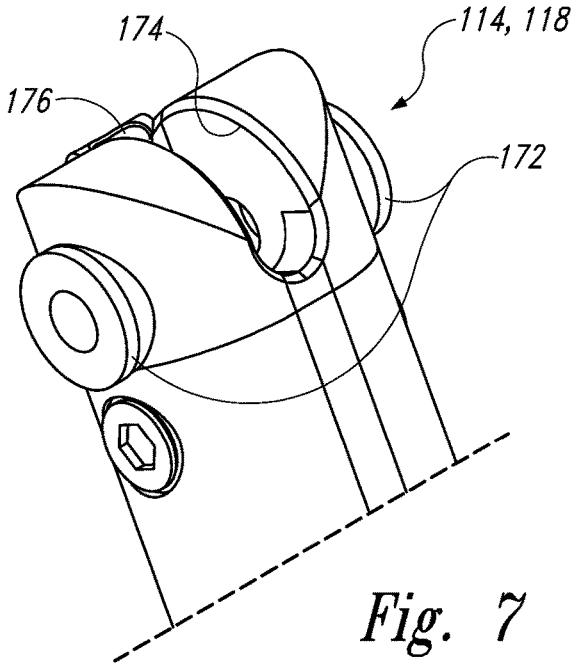
FIGS. 7 and 8 are perspective views of an end portion of a second segment of the arm of the headset shown in FIG. 1.
Figure 8:
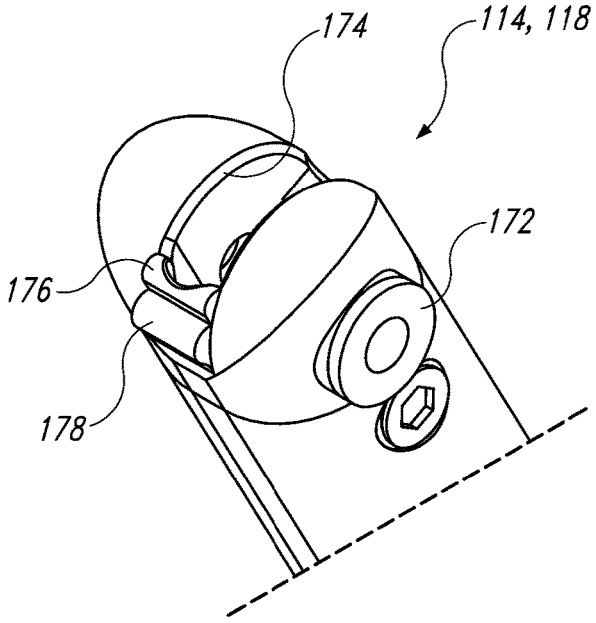

FIGS. 7 and 8 are perspective views of the second end portion 118 of the second segment 114. As shown in FIGS. 7 and 8, the second segment 114 can include collars 172 projecting from opposite respective sides of the second segment 114. The collars 172 can support the bearings 166 and the axle 148 between the interior region 120 of the second segment 114 and the bearings 166. The second segment 114 can further include a slot 174 between the headpiece 102 and the interior region 120 of the second segment 114. In at least some embodiments, the slot 174 is oriented to be substantially perpendicular to the axis 144, such as within 20 degrees of being exactly perpendicular to the axis 144. As discussed below, this configuration of the slot 174 can facilitate cord management within the arm 106*a*. The second segment 114 can still further include a snapping nub 176 and a stopping nub 178 that interact with the spring pin 150. For example, when the arm 106*a* is in the unfolded state, the spring pin 150 can be nested between the snapping nub 176 and a stopping nub 178. From this position, the snapping nub 176 can resiliently shift the spring pin 150 when the arm 106*a* is moved toward the folded state, thereby providing some tactile resistance to this transition. Correspondingly, interaction between the snapping nub 176 and the spring pin 150 can provide desirable tactile feedback when the arm 106*a* is moved from the folded state toward the unfolded state.

Figure 9:
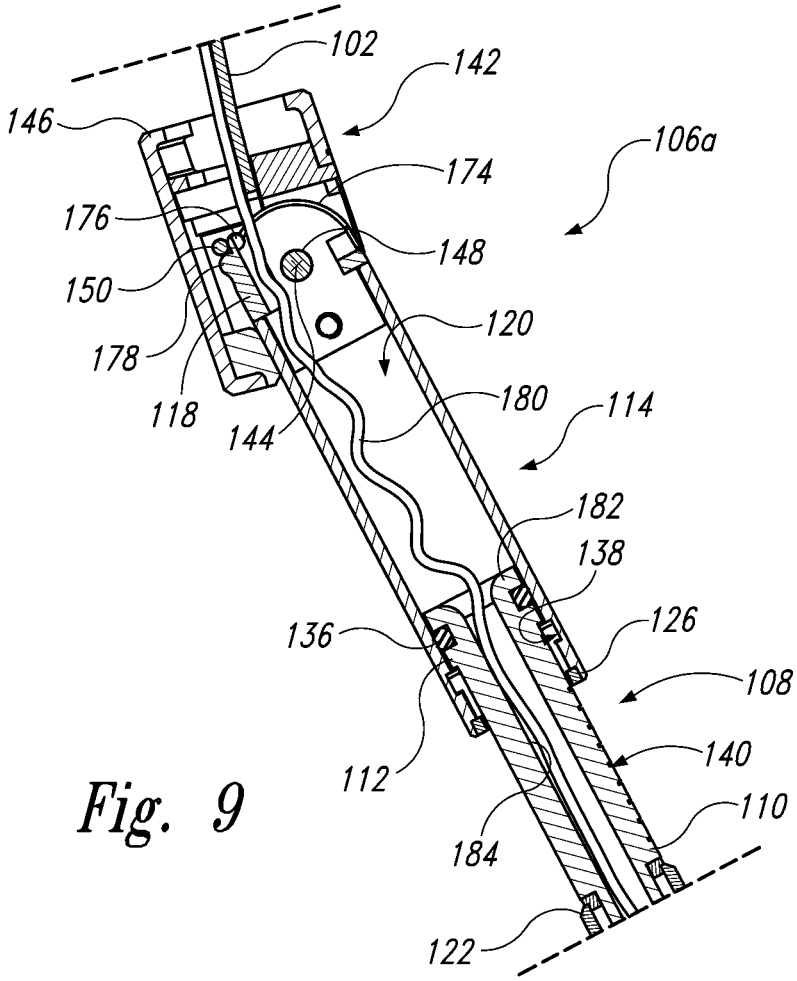
FIG. 9 is a cross-sectional side view of the arm and a cord of the headset shown in FIG. 1 taken along the line A-A in FIG. 2 with the arm in a lengthened state and an unfolded state.

FIG. 9 is a cross-sectional side view of the arm 106*a* taken along the line A-A in FIG. 2 with the arm 106*a* in a lengthened state and the unfolded state. As shown in FIG. 9, the headset 100 can include a cord 180 extending between the headpiece 102 and the earpiece 104*a* through the arm 106*a*. The first segment 108 can include a lip 182 at its second end portion 112 and can define a channel 184 extending from the lip 182 toward its first end portion 110. The channel 184 can taper, at the lip 182, inwardly toward the first end portion 110 of the first segment 108. In some embodiments, the channel 184 includes a straight bore through the first segment 108. In other embodiments, the channel 184 can have other suitable forms. The cord 180 can extend from the headpiece 102 into the interior region 120 of the second segment 114 through the slot 174, extend loosely through a portion of the interior region 120 of the second segment 114 not occupied by the first segment 108, and extend loosely through the channel 184 toward the earpiece 104*a*. As discussed above, the arm 106*a* can be movable between the lengthened state and a shortened state as well as between the folded state and the unfolded state. These movements can change an amount of slack in the cord 180, as further discussed below with further reference to FIGS. 10-12.

Figure 10:
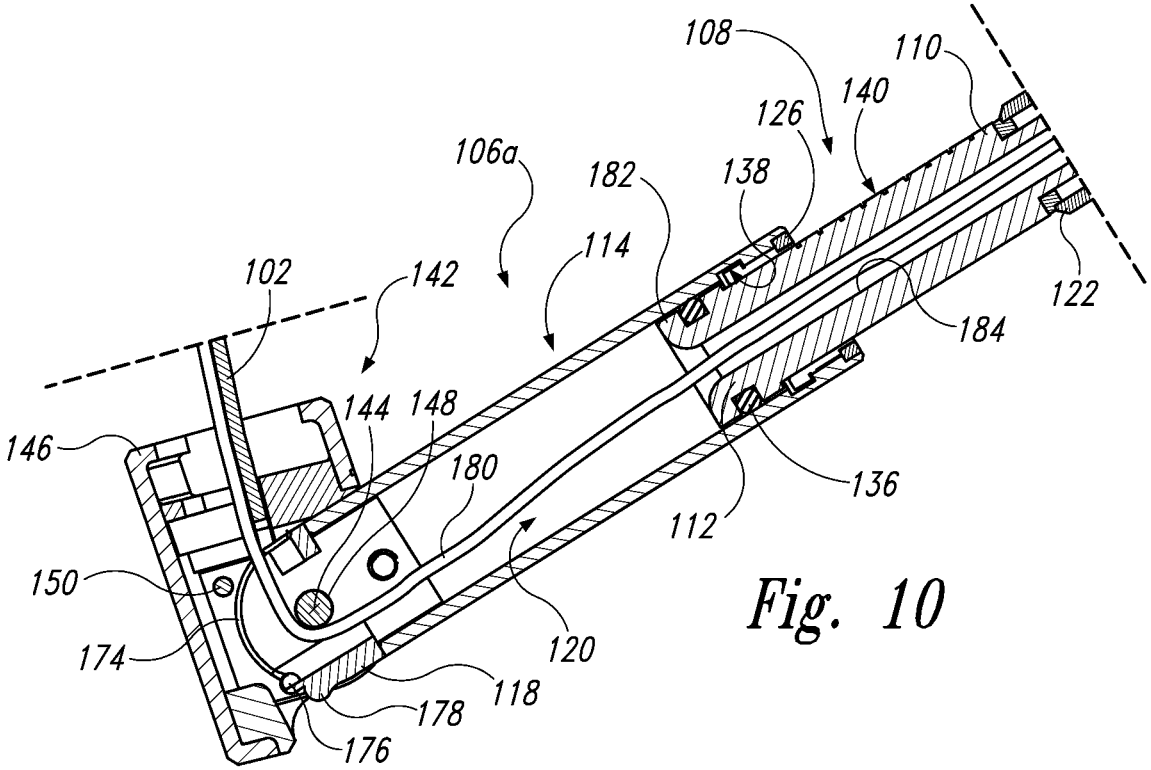
FIG. 10 is a cross-sectional side view of the arm and the cord of the headset shown in FIG. 1 taken along the line A-A in FIG. 2 with the arm in the lengthened state and a folded state.
Figure 11:
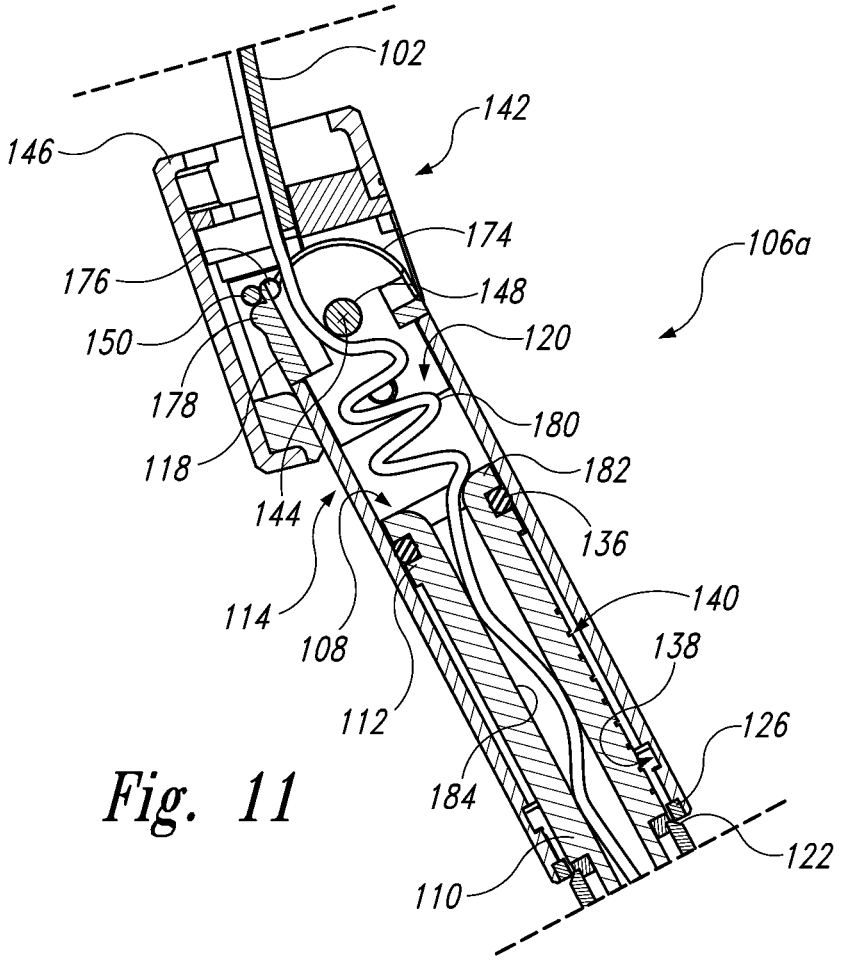
FIG. 11 is a cross-sectional side view of the arm and the cord of the headset shown in FIG. 1 taken along the line A-A in FIG. 2 with the arm in a shortened state and the unfolded state.
Figure 12:
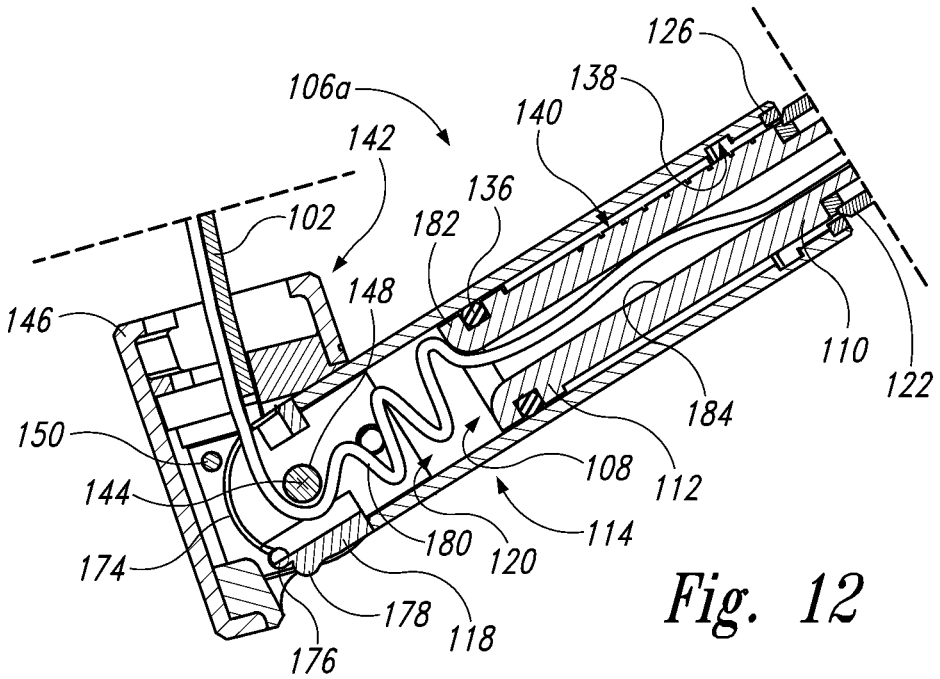
FIG. 12 is a cross-sectional side view of the arm and the cord of the headset shown in FIG. 1 taken along the line A-A in FIG. 2 with the arm in the shortened state and the folded state.

FIGS. 10-12 are a cross-sectional side views of the arm 106*a* and the cord 180 with the arm 106*a* shown in various states. Specifically, in FIG. 10, the arm 106*a* is in the lengthened state and the folded state; in FIG. 11, the arm 106*a* is in the shortened state and the unfolded state; and in FIG. 12, the arm 106*a* is in the shortened state and the folded state. Together, FIGS. 9-12 show how slack in the cord 180 can change in at least one embodiment of the present technology as the arm 106*a* moves between the various states. As shown in FIG. 9 relative to FIG. 10, moving the arm 106*a* from the folded state to the unfolded state can increase slack in the cord 180. Correspondingly, moving the arm 106*a* from the unfolded state to the folded state can decrease slack in the cord 180. As shown in FIG. 11 relative to FIG. 9, moving the arm 106*a* from the lengthened state to the shortened state can increase slack in the cord 180. Correspondingly, moving the arm 106*a* from the shortened state to the lengthened state can decrease slack in the cord 180. Conventionally, there tends to be a significant potential for snagging, kinking, doubling over, and/or other undesirable behavior of the cord 180 in conjunction with such increases and decreases in slack in the cord 180. The arm 106*a* can include features that reduce or eliminate this potential.

Among other features, the channel 184 can have a transverse cross-sectional area that is sufficiently small to reduce gathering of increased slack in the cord 180 within the channel 184 when the arm 106*a* moves from the lengthened state toward the shortened state. In contrast to the channel 184, the portion of the interior region 120 of the second segment 114 not occupied by the first segment 108 can be relatively spacious. Due to this relationship and/or other internal features of the arm 106*a*, increased slack in the cord 180 can preferentially gather within the interior region 120 of the second segment 114 when the arm 106*a* moves from the lengthened state toward the shortened state and when the arm 106*a* moves from the folded state toward the unfolded state.

Longitudinal movement of the first segment 108 relative to the second segment 114 can change a volume of a portion of the interior region 120 of the second segment 114 within which increased slack in the cord 180 preferentially gathers when the arm 106*a* moves from the lengthened state toward the shortened state. When the arm 106*a* is in the shortened state, however, the second end portion 112 of the first segment 108 can still be longitudinally spaced apart from the axis 144, leaving ample room for gathering additional slack in the cord 180. Furthermore, the lip 182 can urge increased slack in the cord 180 to remain within the interior region 120 of the second segment 114 outside the channel 184 when the arm 106*a* moves from the lengthened state toward the shortened state. The outwardly opening annular groove 138 can be set back from the lip 182 such that the lip 182 shields the o-ring 136 from interaction with the cord 180. Friction between the o-ring 136 and the second segment 114 can resist movement of the arm 106*a* between the lengthened and shortened states such that this movement tends to be smooth and gradual rather than jerking and abrupt. This smooth and gradual movement can cause relatively stable and repeatable self-adjustment of the cord 180. The tapered inside corner of the channel 184 at the lip 182 can facilitate movement of excess slack in the cord 180 into and out of the channel 184 little or no possibility of snagging.

The arm 106*a* can be configured to physically separate slack in the cord 180 from the inside corner at which the second segment 114 bends relative to the shell 146. When slack in the cord 180 is present at the inside corner, the cord 180 may tend to kink and/or exhibit other undesirable behavior. In at least some embodiments, the axle 148 facilitates this separation. The cord 180 can be routed along a side of the axle 148 opposite to a side facing the inside corner. As shown in FIG. 10 relative to FIG. 9, when the arm 106*a* moves from the unfolded state toward the folded state, the cord 180 can bend around the axle 148. As shown in FIGS. 9 and 11, the axle 148 can additionally or alternatively facilitate preferential gathering of additional slack in the cord 180 within a portion of the interior region 120 of the second segment 114 between the axis 144 and the second end portion 112 of the first segment 108 when the arm 106*a* moves from the lengthened state toward the shortened state and when the arm 106*a* moves from the folded state toward the unfolded state.

Figure 13:
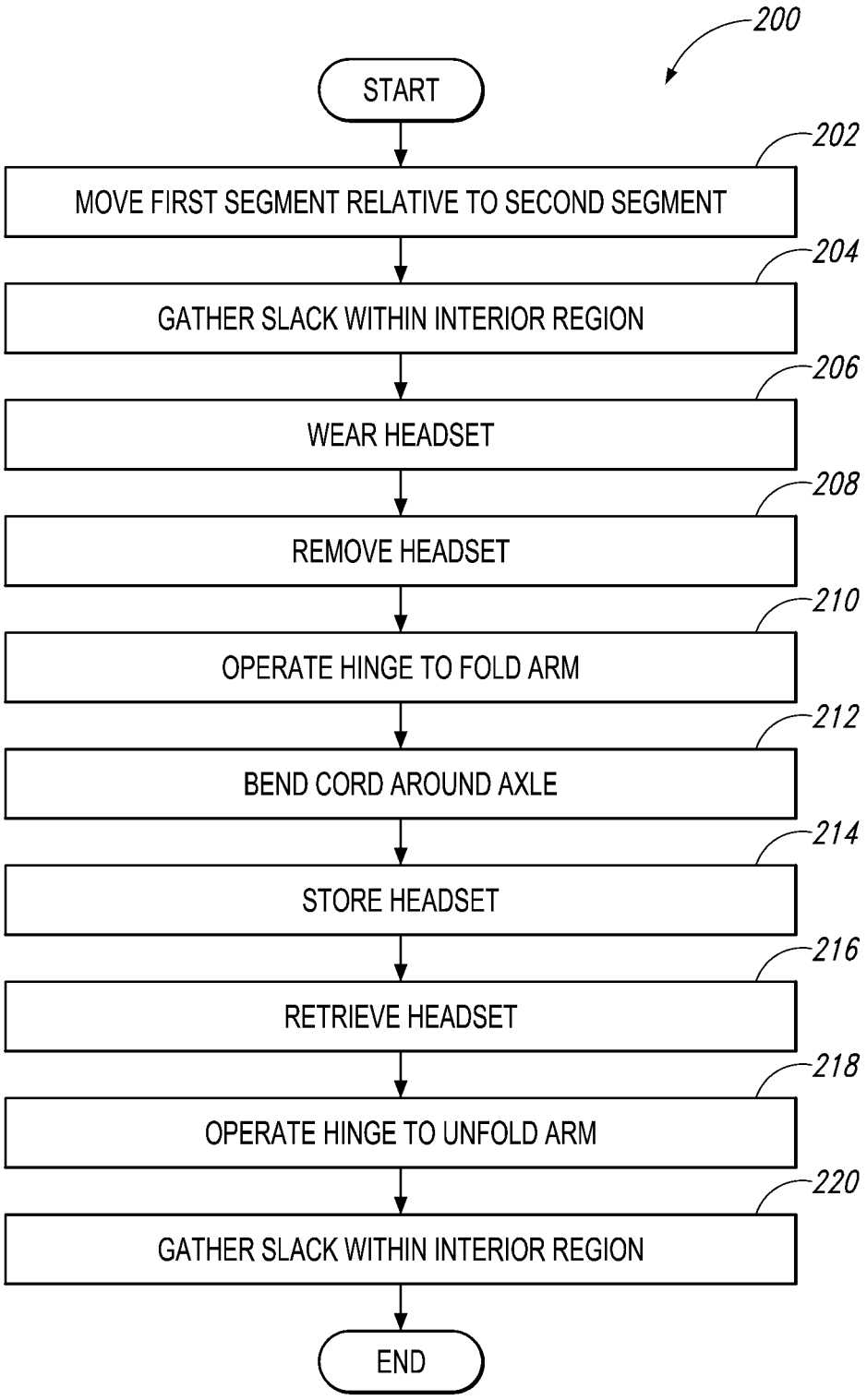
FIG. 13 is a flow chart illustrating a method for operating the headset shown in FIG. 1 in accordance with an embodiment of the present technology.

FIG. 13 is a flow chart illustrating a method 200 for operating the headset 100 in accordance with an embodiment of the present technology. With reference to FIGS. 1-13 together, the method 200 can include moving the first segment 108 relative to the second segment 114 to reduce the length of the arm 106*a* (block 202), such as to achieve a suitable fit for the headset 100. This movement can cause the arm 106*a* to move from the lengthened state toward the shortened state. The method 200 can further include preferentially gathering increased slack in the cord 180 within the interior region 120 of the second segment 114 as the arm 106*a* moves from the lengthened state toward the shortened state (block 204). In at least some embodiments, the method 200 includes moving the first segment 108 telescopically relative to the second segment 114, thereby reducing a volume of the portion of the interior region 120 of the second segment 114 within which increased slack in the cord 180 preferentially gathers. After the length of the arm 106*a* is suitably adjusted and the additional slack in the cord 180 is suitably gathered, the headset 100 can be worn by a user (block 206).

After a period of use, the method 200 can include removing the headset 100 (block 208) and operating the hinge 142 to rotate the arm 106*a* about the axis 144 and thereby move the arm 106*a* relative to the headpiece 102 from the unfolded state toward the folded state (block 210). In conjunction with this movement, the method 200 can include bending the cord 180 around the axle 148 (block 212). With the arm 106*a* folded, the headset 100 can be stored (block 214). After a period of nonuse, the headset 100 can be retrieved (block 216) and the hinge 142 can be operated to unfold the arm 106*a* (block 218). In conjunction with this operation, the method 200 can include preferentially gathering additional slack in the cord 180 within the interior region 120 of the second segment 114.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments of the present technology.

We claim:

1. A headset, comprising:

a headpiece;

an earpiece;

an arm extending between the headpiece and the earpiece, wherein the arm is movable between a lengthened state and a shortened state, and wherein the arm includes— an elongate first segment through which the arm is operably connected to the earpiece, the first segment having a first end portion and an opposite second end portion further from the earpiece than the first end portion, and an elongate second segment through which the arm is operably connected to the headpiece, the second segment defining an interior region within which the second end portion of the first segment is disposed and longitudinally movable; and a cord extending between the headpiece and the earpiece through the arm, wherein increased slack in the cord preferentially gathers within the interior region of the second segment when the arm moves from the lengthened state toward the shortened state.

2. The headset of claim 1 wherein the first and second segments have a telescoping arrangement in which longitudinal movement of the first segment relative to the second segment changes a length of the arm and changes a volume of a portion of the interior region of the second segment within which increased slack in the cord preferentially gathers when the arm moves from the lengthened state toward the shortened state.

3. The headset of claim 1 wherein:

the first segment defines a channel extending from the lip toward the first end portion of the first segment; and a transverse cross-sectional area of the channel is sufficiently small to reduce gathering of increased slack in the cord within the channel when the arm moves from the lengthened state toward the shortened state.

4. The headset of claim 3 wherein the channel tapers inwardly toward the first end portion of the first segment.

5. The headset of claim 3 wherein a transverse cross-sectional area of the channel is sufficiently small to reduce gathering of increased slack in the cord within the channel when the arm moves from the lengthened state toward the shortened state.

6. The headset of claim 3 wherein:

the channel includes a straight bore through the first segment; and the cord extends loosely through the channel.

7. A headset, comprising:

a headpiece;

an earpiece;

an arm extending between the headpiece and the earpiece, wherein the arm defines an interior region, and wherein the arm includes— a hinge operable to rotate the arm about an axis and thereby move the arm relative to the headpiece between a folded state and an unfolded state, and a slot between the headpiece and the interior region of the arm; and a cord extending between the headpiece and the earpiece through the arm, wherein the cord extends into the interior region of the arm toward the earpiece through the slot, and wherein increased slack in the cord preferentially gathers within a portion of the interior region between the axis and the earpiece when the arm moves from the folded state toward the unfolded state.

8. The headset of claim 7 wherein:

the hinge includes an axle extending, at the axis, laterally through the interior region of the arm; and the cord bends around the axle when the arm moves from the unfolded state toward the folded state.

9. The headset of claim 7 wherein a length of the slot is substantially perpendicular to the axis.

* * * * *